US005161095A

United States Patent [19]

Gammache

[11] Patent Number: 5,161,095

[45] Date of Patent: Nov. 3, 1992

[54] FLASHLIGHT WITH SWIVEL HEAD AND ROTARY SWITCH

[76] Inventor: Richard J. Gammache, 1564 Mission Rd., Lancaster, Pa. 17601

[21] Appl. No.: 742,872

[22] Filed: Aug. 9, 1991

Related U.S. Application Data

[63] Continuation-in-part of Ser. No. 565,506, Aug. 10, 1990, Pat. No. 5,043,854.

[51] Int. Cl.[5] ..... F21L 7/00

[52] U.S. Cl. ..... 362/197; 362/199; 362/206; 200/60

[58] Field of Search ..... 362/202, 203, 198–200, 362/197, 205, 206; 200/60

[56] References Cited

U.S. PATENT DOCUMENTS

| | | | |
|---|---|---|---|
| 1,173,984 | 2/1916 | Rosenfeld | 362/206 |
| 1,340,550 | 5/1920 | Madigan | 362/206 |
| 1,404,258 | 1/1922 | Alschuler | 362/206 |
| 1,404,259 | 1/1922 | Alschuler | 362/206 |
| 1,832,563 | 11/1931 | Kuhn | 362/197 |
| 1,832,564 | 11/1931 | Kuhn | 362/197 |
| 1,986,281 | 1/1935 | Nygard | 362/197 |
| 2,225,936 | 12/1940 | Williams | 362/206 |
| 2,256,641 | 9/1941 | Fullmer | 362/206 |
| 3,835,272 | 9/1974 | Wisenbaker | 362/206 |
| 4,737,892 | 4/1988 | Ohashi | 362/206 |
| 4,841,417 | 6/1989 | Maglica | 362/206 |
| 4,890,203 | 12/1989 | Watson | 362/206 |
| 4,907,135 | 3/1990 | Tarrson | 362/206 |
| 4,914,555 | 4/1990 | Gammache | 362/202 |
| 4,956,755 | 9/1990 | Maglica | 362/206 |

*Primary Examiner*—James C. Yeung

[57] ABSTRACT

A flashlight having a casing containing a pair of batteries, a head assembly mounted on an upper end of the casing, and a tail assembly mounted on a lower end of the casing. The head assembly includes a swivel head carrying a bulb with the swivel head being rotatable about a swivel axis which is inclined with respect to a longitudinal axis of the casing. The tail assembly includes a rotary switch for illuminating and extinguishing the bulb. The bulb has a terminal which is connected electrically to a negative terminal on one of the batteries by operating the rotary switch. Another terminal on the bulb is connected electrically to a positive terminal on the other battery. The rotary switch includes a lifter that is movable in response to rotation of the tail cap for lifting a spring out of contact with a conductive insert in the casing lower end thereby electrically disconnecting the conductive means and the battery negative terminal.

16 Claims, 4 Drawing Sheets

FLASHLIGHT WITH SWIVEL HEAD AND ROTARY SWITCH

This application is a continuation-in-part of application Ser. No. 07/565,506 filed Aug. 10, 1990, U.S. Pat. No. 5,043,854 and incorporated herein by reference.

FIELD OF THE INVENTION

This invention relates generally to flashlights and, in particular, to a flashlight having a swivel head and a rotary switch.

SUMMARY OF THE INVENTION

The present invention provides a flashlight comprising a casing containing a battery, a head assembly mounted on an upper end of the casing and including a swivel head carrying a bulb, and a tail assembly mounted on a lower end of the casing including rotary switch means for illuminating and extinguishing the bulb. The swivel head is rotatable about a swivel axis which is inclined with respect to a longitudinal axis of the casing.

The head assembly also includes a socket member mounted in the swivel head for slidably receiving a bottom portion of the bulb. A lens cap is mounted on the swivel head, and resilient means in the lens cap urges an annular flange on the bulb into engagement with an annular surface on the socket member. The annular bulb flange forms a terminal which is connected electrically to a negative terminal on the battery by operating the rotary switch means in the tail assembly. The bulb has another terminal on the bottom portion thereof which is connected electrically to a positive terminal on the battery.

The tail assembly also includes a tail cap rotatably mounted on the lower end of the casing. A spring electrically connects conductive means on the casing lower end and a negative terminal on the battery in order to illuminate the bulb. The rotary switch means comprises lifter means movable in the response to rotation of the tail cap for lifting the spring out of contact with the conductive means thereby electrically disconnecting the conductive means and the battery negative terminal in order to extinguish the bulb.

DESCRIPTION OF THE PREFERRED EMBODIMENT

Figure 1:
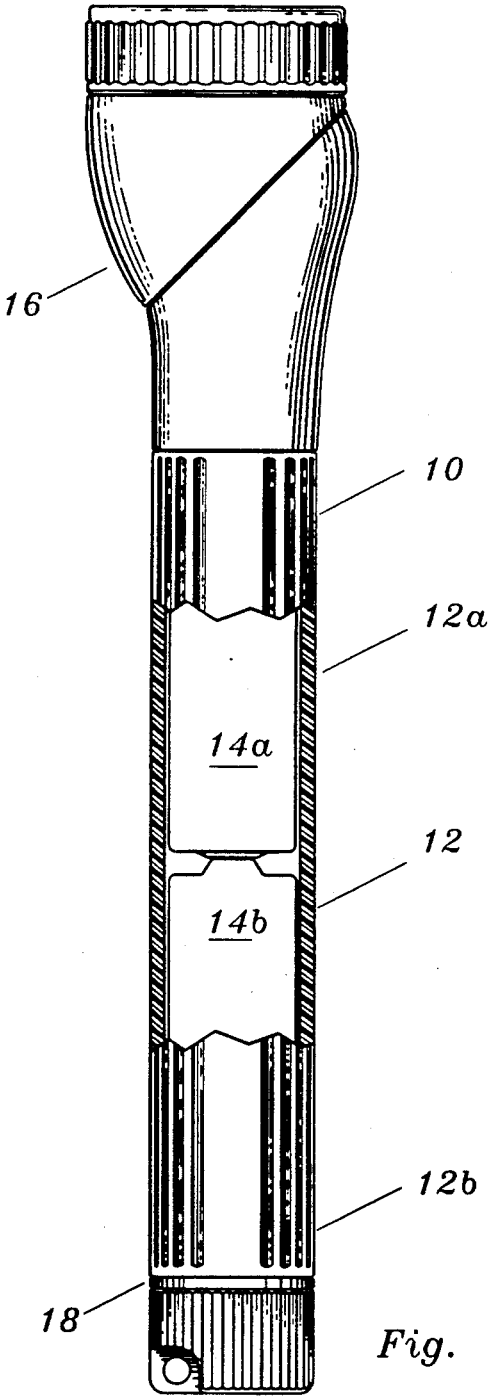
FIG. 1 is a side elevational view, with portions broken away, of a flashlight according to the present invention having a head assembly and a tail assembly.
Figure 2:
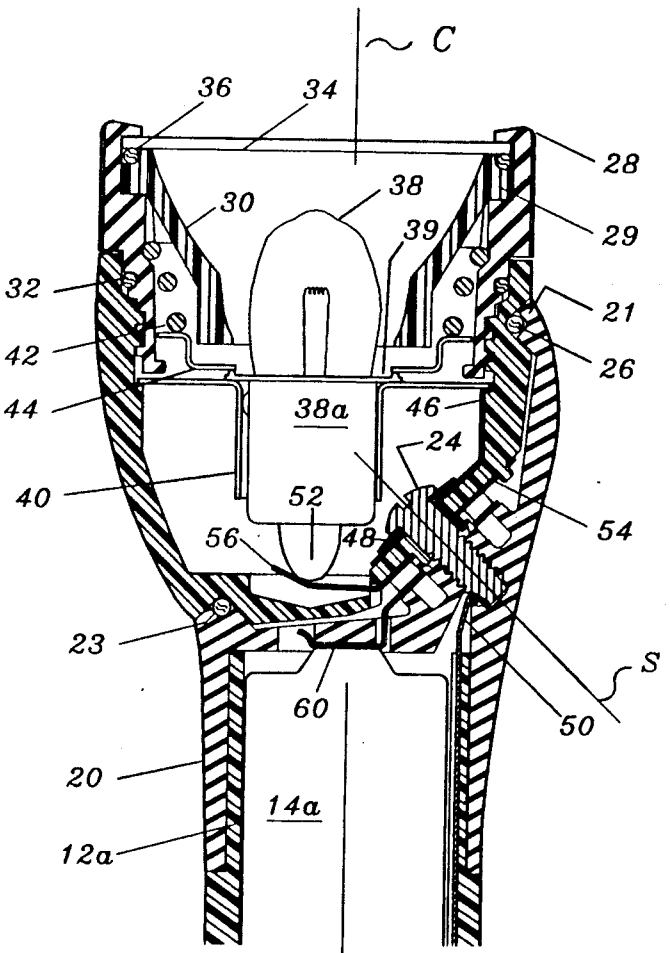
FIG. 2 is an enlarged sectional view of the head assembly.
Figure 3:
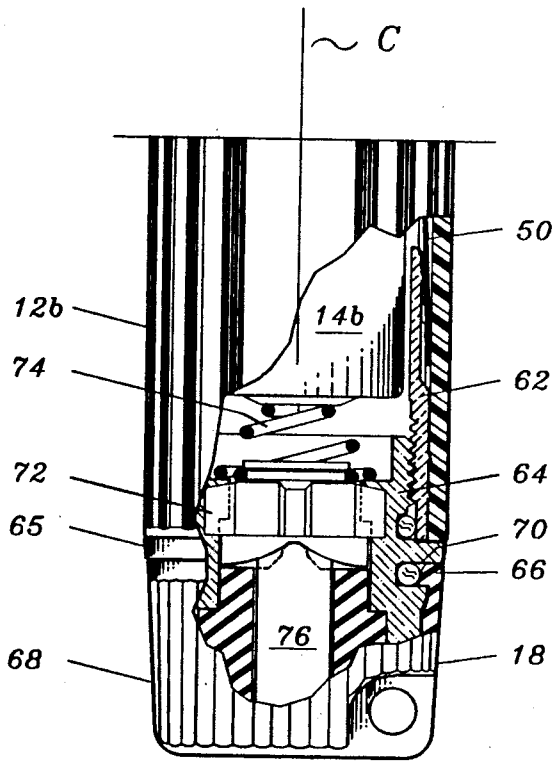
FIG. 3 is an enlarged sectional view of the tail assembly.

Referring to FIGS. 1-3, a flashlight 10 includes a cylindrical casing 12 containing a pair of batteries 14*a*, 14*b*. A head assembly 16 is mounted on an upper end 12*a* of the casing 12, and a tail assembly 18 is mounted on a lower end 12*b* of the casing 12. The head assembly 16 includes a base 20 secured to the casing upper end 12*a* and a swivel head 22 rotatably fastened to the base 20 by a bolt 24. The base 20 and the swivel head 22 are formed of nonconductive material such as nylon. An annular groove 23 in the swivel head 22 is engaged with an annular flange 21 on the base 20. An O-ring 26 is disposed in the groove 23. Swivel head 22 is arranged for rotational movement about a swivel axis S which is disposed at an acute angle of approximately 45 degrees with respect to longitudinal axis C of the casing 12. Since swivel axis S coincides with the centerline of the bolt 24, swivel head 22 actually rotates about bolt 24.

Figure 5:
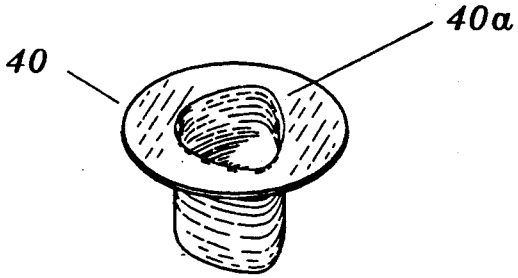
FIG. 5 is a perspective view of another part used in the head assembly.

A lens cap 28 is threaded into the swivel head 22, and a reflector 30 is mounted in the lens cap 28. The lens cap 28 and the reflector 30 are made of conductive or nonconductive material. An O-ring 32 is disposed between the lens cap 28 and the swivel head 20. A lens 34 and an O-ring 36 are mounted in a groove 29 in the lens cap 28. The swivel head 22 carries a bulb 38 and a socket member 40 slidably receiving a bottom portion 38*a* of the bulb 38. When the lens cap 28 is installed on the swivel head 22, resilient means such as a spring 42 retained in the lens cap 28 urges a ring 44 into engagement with an annular flange 39 on the bulb 38 thereby urging this flange 39 into contact with an annular surface 40*a* of the socket member 40. Socket member 40 (also shown in FIG. 5) and ring 44 are formed of conductive material such as aluminum or steel. Bulb 38 may be removed from flashlight 10 when the lens cap 28 is unthreaded from the swivel head 22.

When the bulb 38 is illuminated, rotational movement of the lens cap 28 relative to the swivel head 22 causes reflector 30 to focus the beam of light emitted by the bulb 38 from a wide angle beam to a narrow beam. This rotational movement of lens cap 28 also increases and decreases the compression in spring 42 but the bulb flange 39 is retained in contact with the annular surface 40*a* of the socket member 40.

Figure 4A:
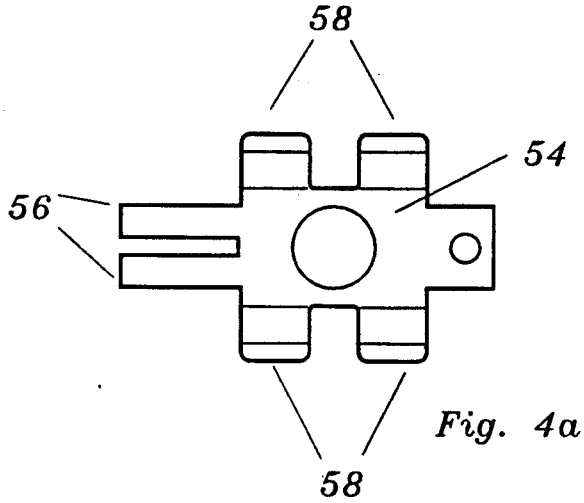
FIG. 4*a* is a top plan view of a part used in the head assembly.
Figure 4B:
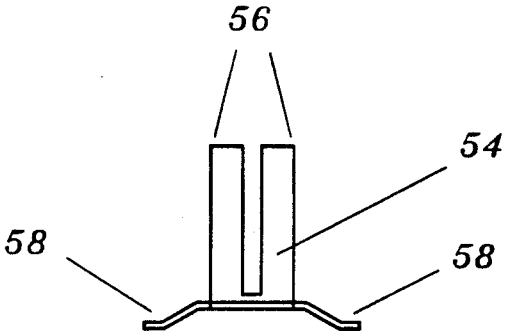
FIG. 4*b* is an end view of the part shown in FIG. 4*a;*

The bulb flange 39 forms an electrical terminal which is connected to a negative terminal of the battery 14*b* via the socket member 40, a socket contact 46, a spring washer 48, bolt 24, a terminal contact 50 and the tail assembly 18. Terminal contact 50 extends lengthwise of the casing 12 from its upper end 12*a* to its lower end 12*b*. Socket contact 46, spring washer 48 and terminal contact 50 are made of conductive material such as brass. Bulb 38 has another electrical terminal 52 which contacts tabs 56 on a rotor contact 54, preferably formed of beryllium copper. Tabs 56 may be deflected to accommodate bulbs of varying lengths. This rotor contact 54 (also shown in FIGS. 4*a* and 4*b*) is attached to the swivel head 20 and has a plurality of projections 58 which engage a battery contact 60 made of brass that is connected to a positive terminal of the battery 14*a*. Swivel head 22 is fastened to base 20 by the bolt 24 which extends through holes in the rotor contact 54 and the battery contact 60 without contacting either the rotor contact 54 or the battery contact 60. Bolt 24 is made of steel and is engaged with an upper end of the terminal contact 50.

When swivel head 22 is rotated relative to base 20 about swivel axis S, reflector 30 and bulb 38 are moved to different positions with respect to the casing 12 in order to direct the beam of light from bulb 38 in different directions. For example, in FIG. 1, swivel head 20 is rotated so that reflector 30 and bulb 38 are in a generally vertical position. When swivel head 22 is rotated 180 degrees about swivel axis S, reflector 30 and bulb 38 will be moved through an arc of 180 degrees to a generally horizontal position. This movement of reflector 30 and bulb 38 is due to the unique shape of the swivel head 22 which is asymmetrical with respect to a horizontal transverse plane extending through the swivel head 20 in FIG. 1.

Figure 6:
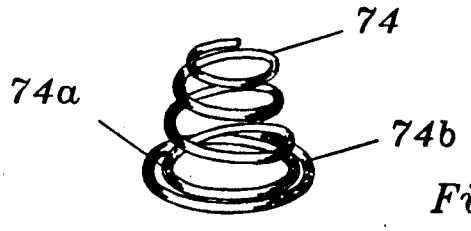
FIGS. 6, 7, 8 and 9 are perspective views of four parts used in the tail assembly.
Figure 7:
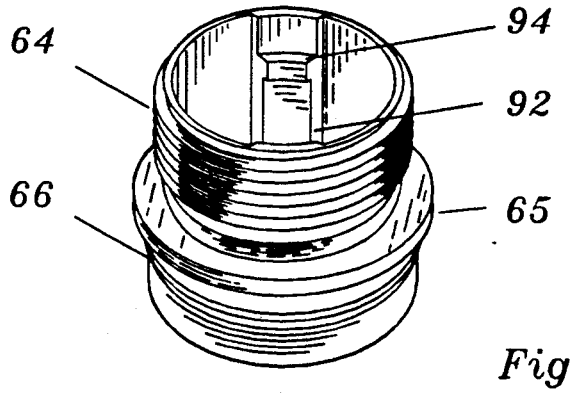
Figure 8:
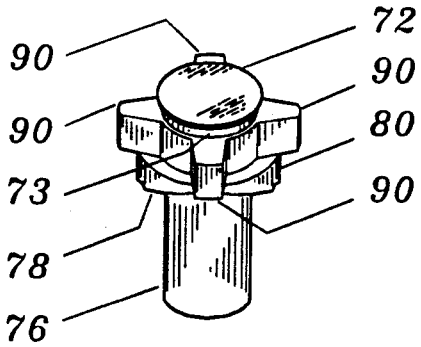
Figure 9:
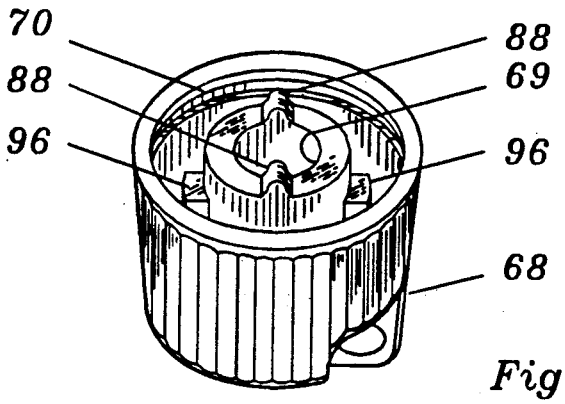
Figure 10:
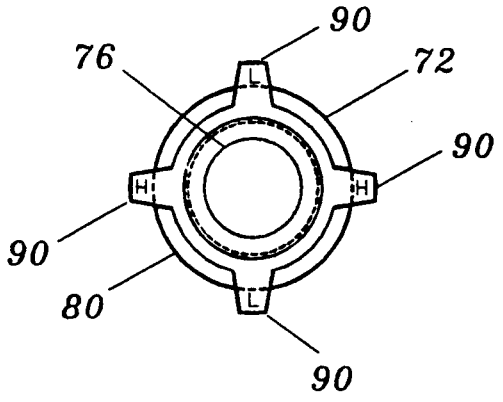
FIG. 10 is a top plan view of the part shown in FIG. 8.
Figure 11:
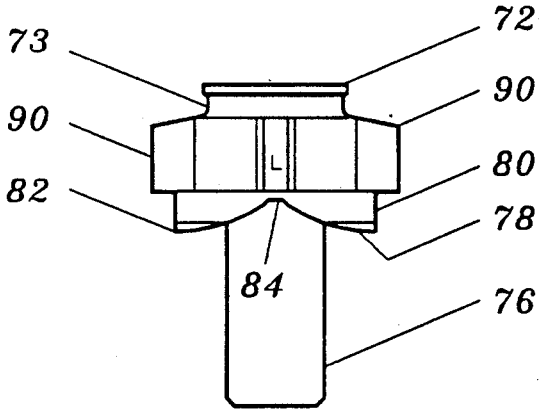
FIG. 11 is a side elevational view of the part shown in FIG. 8.
Figure 12:
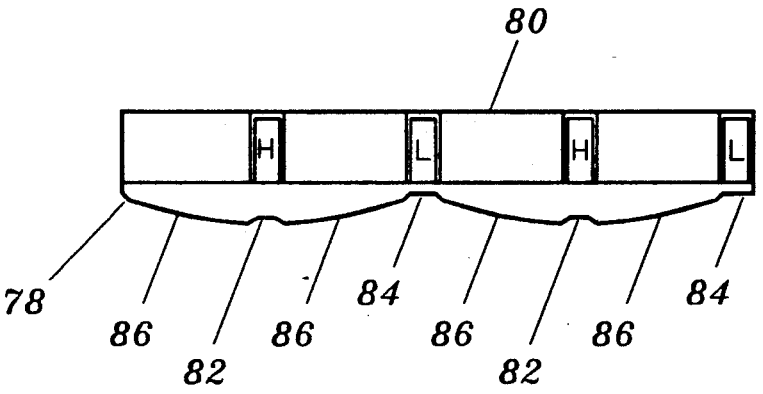
FIG. 12 is a schematic representation of a portion of the part shown in FIG. 8.

Referring to FIGS. 3 and 6–12, the tail cap assembly 18 includes a conductive insert 62 mounted in the lower end 12*b* of the casing 12. The insert 62 is engaged with a lower end of the terminal contact 50. A retainer 64 (also shown in FIG. 7) threaded into the insert 62 has a flange 65 engaged between the lower end 12*b* of the casing 12 and a tail cap 68 (also shown in FIG. 9) which is rotatably mounted on the switch retainer 64. An annular barb 66 on the retainer 64 is engaged in an annular groove 70 in the tail cap 68. The insert 62 and the retainer 64 are formed of metallic material such as aluminum whereas the tail cap 68 is made of plastic material such as nylon. Mounted in the tail cap 68 is a lifter 72 formed of plastic material. A spring 74, made of steel and shown in FIG. 6, is compressed between the lifter 72 and the negative terminal of the battery 14*b*. The spring 74 has an inner bottom coil 74*a* which is snapped into a groove 73 on the lifter 72.

The lifter 72 (also shown in FIGS. 8, 10 and 11) has a center post 76 slidably disposed in a hole 69 in the tail cap 68. The lifter 72 has a cam surface 78 on an underside of a flange 80. As seen in the schematic representation of FIG. 12, the cam surface 78 includes a pair of high detents 82 and a pair of low detents 84 with inclined ramps 86 extending between the detents 82, 84. The tail cap 68 has a pair of cam lobes 88 arranged for engagement with the cam surface 78 on the lifter 72. Four fins 90 extend outwardly on the lifter 72 to support an outer bottom coil 74*b* of the spring 74. The fins 90 engage two projections 92 formed on an inside cylindrical wall of the retainer 64 to prevent rotational movement of the lifter 72 relative to the retainer 64.

When the tail cap 68 is rotated with respect to the casing 12, the cam lobes 88 ride along the inclined ramps 86 until they become engaged in either the high detents 82 or the low detents 84. If the tail cap 68 is rotated to an "off" position where the cam lobes 88 are engaged in the high detents 82, the lifter 72 is pushed upwardly as viewed in FIG. 3 and the outer bottom coil 74*a* of the spring 74 is lifted out of contact with a pair of ledges 94 on the retainer 64 thereby electrically disconnecting the retainer 64 and the negative terminal of battery 14*b*. This extinguishes the bulb 38. If the tail cap 68 is rotated to an "on" position where the cam lobes 88 are engaged in the low detents 84, the lifter 72 moves downwardly as viewed in FIG. 3 and the outer bottom coil 74*b* of spring 74 contacts the ledges 94 on the retainer 64 thereby electrically connecting retainer 64 and the negative terminal of battery 14*b*. This illuminates the bulb 38. The tail cap 68 is rotated 90 degrees with respect to the casing 12 between the "on" and "off" positions. Projections 96 formed inside the tail cap 68 engage the projections 92 in the retainer 64 to limit the rotational movement of the tail cap 68.

What is claimed is:

1. A flashlight comprising:

a casing containing a battery;

a head assembly mounted on an upper end of said casing and including a swivel head carrying a bulb, said swivel head being rotatable about a swivel axis which is inclined with respect to a longitudinal axis of said casing;

a tail assembly mounted on a lower end of said casing including rotary switch mans for illuminating and extinguishing said bulb, said tail assembly including a tail cap rotatably mounted on said lower end of said casing;

conductive means on said lower end of said casing;

a spring for electrically connecting said conductive means and a negative terminal on said battery in order to illuminate said bulb; and said rotary switch means including lifter means movable in response to rotation of said tail cap for lifting said spring out of contact with said conductive means thereby electrically disconnecting said conductive means and said battery negative terminal in order to extinguish said bulb.

2. The flashlight of claim 1, further comprising a socket member mounted in said swivel head for slidably receiving a bottom portion of said bulb.

3. The flashlight of claim 2, wherein:

said head assembly comprises a base secured to an upper end of said casing; and said swivel head is rotatably fastened to said base.

4. The flashlight of claim 2, further comprising:

a lens cap mounted on said swivel head; and resilient means in said lens cap for urging an annular flange on said bulb into engagement with an annular surface on said socket member.

5. The flashlight of claim 4, wherein said annular flange on said bulb forms a terminal which is connected electrically to a negative terminal on said battery by operating said rotary switch means.

6. The flashlight of claim 5, wherein said bulb has another terminal on said bottom portion which is connected electrically to a positive terminal on said battery.

7. The flashlight of claim 6, further comprising contact means for electrically connecting said another terminal on said bulb and said battery positive terminal.

8. The flashlight of claim 7, wherein said contact means comprises a rotor contact having a pair of tabs for contacting said another terminal and a plurality of projections for contacting a battery contact that is connected to said battery positive terminal.

9. The flashlight of claim 1, wherein said tail cap has a pair of cam lobes arranged for engagement with a cam surface on said lifter means.

10. The flashlight of claim 9, wherein said cam surface includes a pair of high detents and a pair of low detents with inclined ramps extending between said high and low detents.

11. The flashlight of claim 10, wherein said bulb is illuminated when said cam lobes are disposed in said low detents, and wherein said bulb is extinguished when said cam lobes are disposed in said high detents.

12. The flashlight of claim 11, wherein said lifter means has a post slidably disposed in a hole in said tail cap.

13. The flashlight of claim 12, wherein said lifter means has a plurality of fins for supporting said spring.

14. The flashlight of claim 13, wherein:

said conductive means comprises an insert secured in said lower end of said casing; and said fins are engaged in slots formed in said insert to prevent rotational movement of said lifter means relative to said insert.

15. A flashlight comprising:

a casing containing a battery;

a head assembly mounted on an upper end of said casing;

a bulb disposed in said head assembly;

a tail assembly mounted on a lower end of said casing including rotary switch means for illuminating and extinguishing said bulb, said tail assembly including a tail cap rotatably mounted on said lower end of said casing;

conductive means on said lower end of said casing;

spring means for electrically connected said conductive means and a terminal on said battery in order to illuminate said bulb; and said rotary switch means including lifter means movable in response to rotation of said tail cap for lifting said spring means out of contact with said conductive means thereby electrically disconnecting said conductive means and said battery terminal in order to extinguish said bulb.

16. The flashlight of claim 15, wherein:

said tail cap has a pair of cam lobes arranged for engagement with a cam surface on said lifter means;

said cam surface includes a pair of high detents and a pair of low detents with inclined ramps extending between said high and low detents; and said bulb is illuminated with said cam lobes are disposed in said low detents, and said bulb is extinguished when said cam lobes are disposed in said high detents.

* * * * *